US005520519A

United States Patent [19]

Birkeland

[11] Patent Number: 5,520,519

[45] Date of Patent: May 28, 1996

[54] PERFORMANCE ENHANCING BASE FOR SMALL COMPRESSOR

[75] Inventor: Thomas A. Birkeland, Buffalo Grove, Ill.

[73] Assignee: Seiko Epson Corporation, Tokyo, Japan

[21] Appl. No.: 303,358

[22] Filed: Sep. 9, 1994

[51] Int. Cl.[6] ..... F04B 11/00; F04B 49/08; F04B 53/16

[52] U.S. Cl. ..... 417/63; 417/312; 417/360; 417/540; 417/307; 92/161

[58] Field of Search ..... 417/63, 307, 312, 417/360, 440, 540, 61; 92/146, 161

[56] References Cited

U.S. PATENT DOCUMENTS

| | | | |
|---|---|---|---|
| 176,795 | 5/1876 | Manz | 92/161 |
| 787,117 | 4/1905 | Scholl | 92/146 |
| 2,961,149 | 11/1960 | Hull | 417/540 |
| 4,810,169 | 3/1989 | Kranzle | 417/63 |

OTHER PUBLICATIONS

Badger Air–Brush Co., Franklin Park, IL, Catalog BA 300, vol. 10, p. 20, published 1990.

W. R. Brown Co., North Chicago, IL, "No. HS802 Bleeder Valve", advertisement, date unknown.

Catalog Sales Division, Greenwood, IN, "The Catalog," date unkown, p. 2.

Paasche Airbrush Co., Harwood Heights, IL, catalog, date unkown, p. 14.

Watts FluidAir, Kittery, ME, "General Line FRL Catalog", published Oct. 1991, pp. 14–15, 38–39.

*Primary Examiner*—Richard A. Bertsch
*Assistant Examiner*—Roland G. McAndrews, Jr.
*Attorney, Agent, or Firm*—Sughrue, Mion, Zinn, Macpeak & Seas

[57] ABSTRACT

A base attachment for use with an air compressor having a motor enclosed within a housing, a compressor unit operatively connected to the motor and emitting compressed air from an air outlet, the base attachment including a tubular segment having a first end portion for receiving the compressed air emitted by the air outlet, and a second end portion for emitting the air to a pneumatically powered tool, wherein the tubular segment is constructed and arranged to provide a temperature and pressure regulating sink for emitting compressed air which is cooler and at more uniform pressure than air emitted directly from the air outlet.

19 Claims, 2 Drawing Sheets

PERFORMANCE ENHANCING BASE FOR SMALL COMPRESSOR

BACKGROUND OF THE INVENTION

The present invention relates to small compressors of the type used to power airbrushes or similar tools, and specifically to an attachment for such a compressor which, among other things, improves the temperature and pressure characteristics of the compressor.

Conventional small compressors of the type used with airbrushes typically are powered by shaded pole motors, as opposed to capacitor start motors used in larger compressors. Small compressors of the type referred to presently may also be defined as having motors producing under ½ horsepower. Such compressors are used by commercial artists, photographers, cake decorators, hobbyists and manicurists, among others.

A common operational problem of such compressors, especially when used in an airbrushing environment is that the compressor runs continually. Such continual operation generates excessive heat and vibration. Excessive heat during compressor operation damages airbrush hoses and control devices, and also promotes corrosion at the point the hot air is finally cooled and condenses on various components of the system. Larger compressors often employ elaborate aftercooler devices to lower air temperature where necessary. However, such devices are impractical for use with small compressors. Vibration of the compressor is annoying to the operator, and has also been known to cause the compressor to "walk" across a table or other substrate.

Another drawback of conventional small compressors, especially those incorporating reciprocating pistons, is that the pistons emit the compressed air on a pulsating basis, which tends to vary the pressure received by the airbrush. Such unstable pressure flow interferes with the desired uniform flow needed for optimum airbrush operation, and results in unsatisfactory work product. On larger compressors, a storage tank or reservoir is provided which absorbs the unwanted pulsations. These storage tanks, which typically have a low surface to volume ratio of less than 1:1, are normally unsuitable for use with small compressors.

Yet another drawback of conventional small compressors is that there is no way to easily depressurize the system once the compressor is turned off. Instead, a significant pressure load is held within the system. Once the operator desires to restart the compressor, it is often difficult for the compressor motor to overcome the stored pressure load. Repeated restarts of this nature cause additional wear and tear and shorten the working life of the compressor.

Still another drawback of conventional small compressors is the inability to accurately monitor and control system pressure. Attempts to control the output of small compressors typically involve the insertion of a regulator which controls downstream air pressure only, i.e., the pressure between the regulator and the air tool to which it is connected. Any enclosed upstream volume (hose, piping or reservoir) between the compressor and the regulator receives the maximum output pressure of the compressor at all times, creating significant back pressure. Running constantly, the compressor is always pumping air against a backpressure equal to its maximum output, and works very hard in the process, This results in maximum wear on the compressor and the generation of excess heat and noise. Also, some small compressors are provided with needle-type bleeder to valves which relieve excess pressure. However, such valves are difficult to accurately adjust and often lose their adjustment through compressor vibration. Further, standard dry air pressure gauges cannot be used effectively on small air compressors. Pulsation and vibration generated by the compressor make the needle vibrate so violently as to be virtually unreadable. Gauge life is also extremely short because of the constant shock.

Accordingly, a principal object of the present invention is to provide an improved compressor attachment which dissipates compressor-generated heat before it can be transmitted to the pneumatic tool.

Another object of the present invention is to provide an improved compressor attachment which ameliorates the compressed air output pulses inherent with small compressors, especially the piston type.

Yet another object of the present invention is to provide an improved compressor attachment which provides the operator with precise control over pressure output.

Still another object of the present invention is to provide an improved compressor attachment with features for minimizing stored pressure loading upon shutting off of the compressor.

A still further object of the present invention is to provide an improved compressor attachment with devices for minimizing excessive vibration and the unwanted "walking" of the compressor across the substrate.

SUMMARY OF THE INVENTION

Accordingly, the above-listed objects are met or exceeded by the present base attachment for small, continuously running air compressors which features positive air pressure control and an effective visual display of system performance. In addition, the damaging effects of heat, output pulsation and retained pressure loading are eliminated. Basically, the present attachment includes a tubular base for the compressor which is in fluid communication between the compressor output and the air supply hose to the airbrush or other pneumatic tool. The tubular base is preferably conductive to provide a heat sink, and is dimensioned to create a pressure reservoir for minimizing air pulses. A pressure relief valve is preferably connected between the tubular segment and the air supply hose for accurate pressure control, as well as affording release of excess pressure to prevent backpressure buildup.

More specifically, the present invention provides a base attachment for use with an air compressor having a motor enclosed within a housing, a compressor unit operatively connected to the motor and emitting compressed air from an air outlet. The base attachment includes a tubular segment having a first end portion for receiving the compressed air emitted by the air outlet, and a second end portion for emitting the air to a pneumatically powered tool. A significant feature of the present attachment is that the tubular segment is constructed and arranged to provide a temperature and pressure regulating sink for emitting compressed air which is cooler and at more uniform pressure than air emitted directly from the air outlet.

In another embodiment, the present invention provides an attachment for a compressor having an electric motor enclosed within a housing, a compressor unit operatively connected to the motor, the compressor unit emitting compressed air from an air outlet, and at least one foot supporting the compressor on a substrate. The base attachment includes a tubular segment having a first end portion for receiving the compressed air emitted by the air outlet, and a second end portion for emitting the air to a pneumatically powered tool. A pressure control device is connected to the second end portion for regulating the pressure of both the compressed air contained in the tubular segment as well as the compressed air emitted from the second end.

In still another embodiment, the present invention provides an air compressor and base assembly, including an air compressor having a motor enclosed within a housing, a compressor unit operatively connected to the motor and having an air outlet for emitting compressed air. A base attachment includes a tubular segment having a first end portion for receiving the compressed air emitted by the air outlet, and a second end portion for emitting the air to a pneumatically powered tool. A pressure control device is connected to the second end portion for regulating the pressure of both the compressed air contained in the tubular segment as well as the compressed air emitted from the second end. The tubular segment is constructed and arranged to provide a temperature and pressure controlling sink so that the compressed air emitted from the second end is cooler and at more uniform pressure than air emitted directly from the air outlet.

Another feature of the present compressor attachment is that it allows the compressor to work at a reduced system pressure, extending compressor life while at the same time reducing the heat of compression and reducing the operating noise level. In addition, the attachment presents an attractive, durable, compact package only slightly larger than the compressor itself. Designed to have the compressor mounted on it, the present compressor attachment provides a more stable mounting platform, and preferably includes resilient feet to eliminate the problem of compressor "walking". Finally, the present compressor attachment, which can be constructed to fit any small air compressor, can be retrofitted to any existing compressor which is already in use.

DETAILED DESCRIPTION OF THE PREFERRED EMBODIMENT

Figure 1:
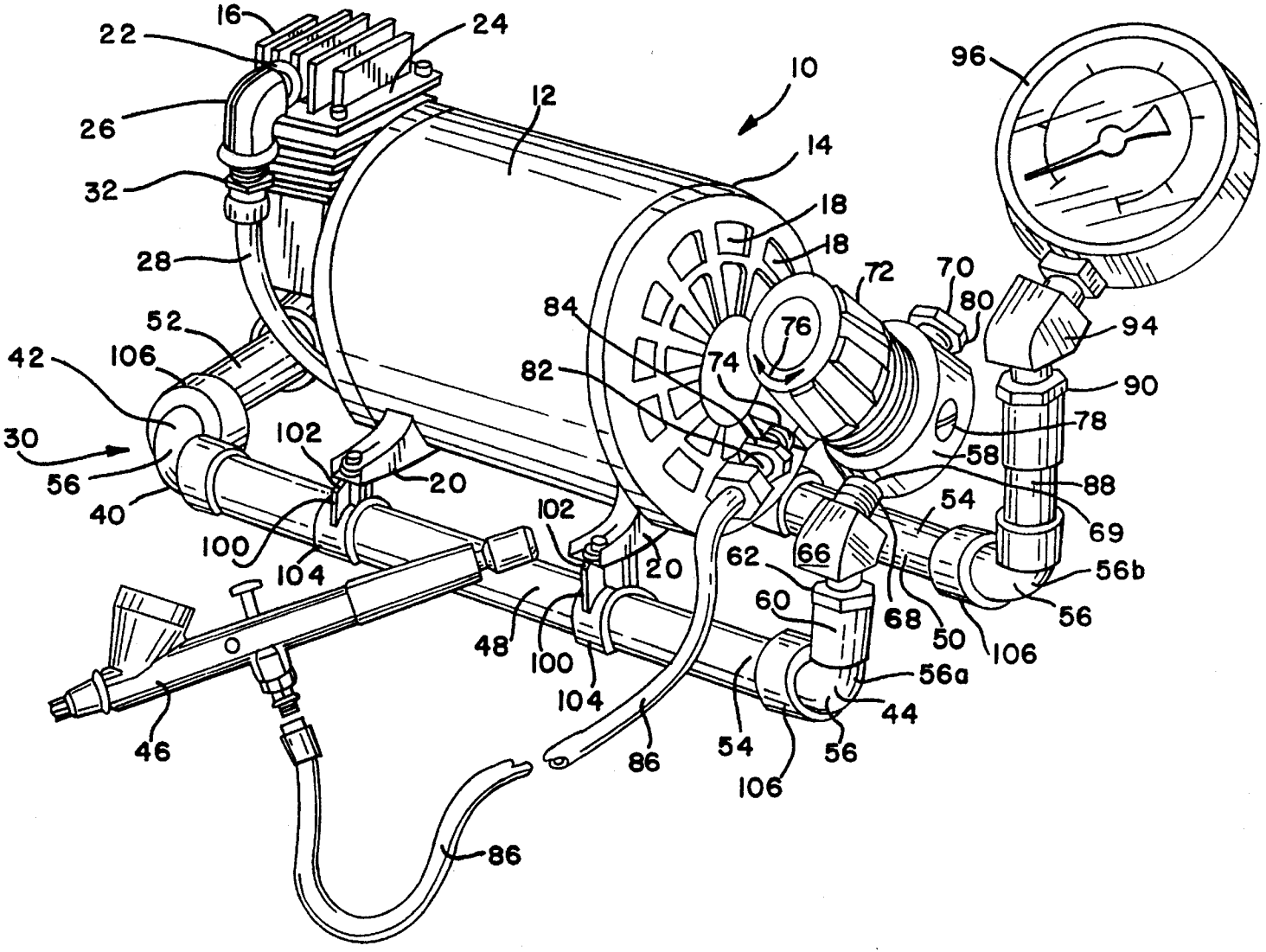
FIG. 1 is a top perspective elevational view of a compressor equipped with the present compressor attachment.

Referring now to the drawings, a small compressor suitable for use with the present compressor attachment is generally designated 10 and includes a motor 12 enclosed by a housing 14, which in turn is connected to a compressor unit 16. The compressor unit 16 is depicted as the piston type, however it is contemplated that the present invention may be utilized with diaphragm type compressors as well. The present invention is concerned with small compressors as defined above, e.g. having shaded pole motors and/or motors with outputs of ½ horsepower or less. Included on the housing 14 are a plurality of air vent openings 18 and at least one and preferably four support feet 20. A conventional line cord (not shown) connects the motor 12 with A.C. power.

Figure 2:
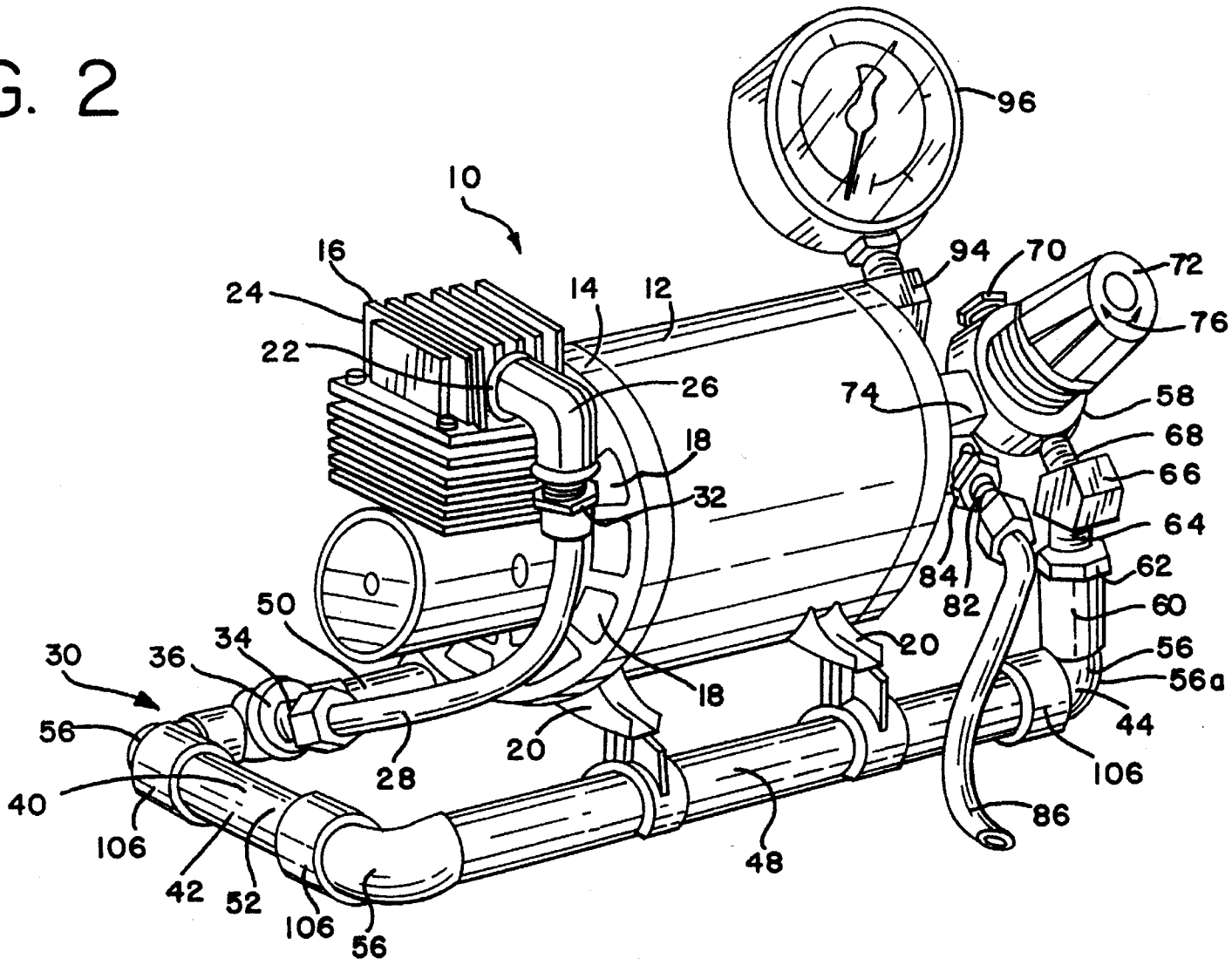
FIG. 2 is a side view of the compressor and attachment depicted in FIG. 1.

Compressed air is emitted from an air outlet 22 preferably located in the head 24 of the compressor unit 16. A threaded elbow 26 and an air tube 28 connect the air outlet 22 to the present compressor attachment, generally designated 30. Suitable locknuts 32 or other conventional locking devices are used to secure the air tube 28 to the air outlet 22. Opposite the elbow 26, the air tube 28 is connected in a like manner to a nipple 34 which in turn is threaded into an air inlet 36 (best seen in FIG. 2). In the preferred embodiment, the air tube 28 is made of a heat insulating material such as nylon which prevents heat generated by the operation of the compressor unit 16 from being conducted to the attachment 30.

The main component of the compressor attachment 30 is a tubular segment 40 having a first end portion 42 for receiving the compressed air emitted by the air outlet 22, and a second end portion 44 for emitting the air to a pneumatically powered tool 46, such as an airbrush. For reasons of heat dissipation, it is preferred that the second end portion 44 be as remote as possible from the first end portion 42. It is contemplated that the present attachment 30 may be used equally with airbrushes of the bleeder or non-bleeder types, or with multiple airbrushes.

More specifically, the preferred configuration of the attachment 30 is that the tubular segment 40 is generally U-shaped, having a pair of generally parallel first and second leg portions 48, 50 joined at corresponding ends by a bridge portion 52. The leg and bridge portions 48–52 are preferably tubular and are in fluid communication with each other. It is also contemplated that the segment 40 may take other shapes as desired, including, but not limited to triangular, polygonal and/or circular configurations. Since an important function of the attachment 30 is to dissipate heat, the leg and bridge portions 48–52 are made of a thermally conductive material such as copper. For aesthetic purposes, the copper may be plated with nickel or other suitable material.

At free ends 54 of each of the leg portions 48, 50 are disposed upwardly projecting elbows 56. Similar elbows 56 are placed at the junction of the bridge 52 with the leg portions 48, 58. The elbows 56 are fastened to the tubular portions 48–52 by soldering or other fastening technologies as are known in the art. Since in the preferred embodiment copper tubing is used to fabricate the tubular segment 40, it is contemplated that commonly available copper fittings may be used wherever possible. It is also contemplated that other conductive materials and/or methods of fabrication may be used to achieve the same results.

A pressure control device 58 is secured to a first elbow **56*a* by means of a threaded pipe adapter 60 which includes a threaded hex portion 62. The threaded hex portion 62 accommodates a threaded nipple 64 which threadably engages a 45 degree street elbow 66. A male end 68 of the street elbow 66 engages a threaded port 69 in the pressure control device 58. The pressure control device 58 is preferably a pressure control valve or a relief valve. A preferred type of valve is manufactured by Watts Fluidair, Kittery, Me. under part no. 134-02-50. The pressure control valve 58** provides precision control to the operator to the extent that air pressure may be adjusted to within 0.5 p.s.i. This level of precision was formerly not available to small compressors without incurring detrimental side effects.

A main feature of the pressure control valve 58 is that it bleeds off excess pressure through an exhaust port 70 to avoid a buildup of backpressure at the compressor unit 16. Thus, the specific location of the pressure control valve 58 on the segment 40 is not deemed to be critical. However, it is preferred that the pressure control device 58 be located far enough away from the compressor air outlet 22 to prevent internal damage to the device 58 from heat.

Also included on the pressure control device 58 is a pressure control selector 72 with which the operator can select the desired air pressure of compressed air emitted from the attachment 30. Specifically, the air is emitted from an outlet port 74. In the preferred embodiment, the selector 72 has indicator markings 76 to facilitate correct use. A supplemental port 78 is normally plugged, but is designed to accommodate a second airbrush 46. If desired, the exhaust port 70 may be provided with a muffler 80.

The pressure control device 58 features the ability to adjust automatically to a change in demand of air volume while maintaining the set system pressure. For example: a compressor equipped with the attachment 30 and two airbrushes 46 (#1 & #2) attached would have a shut-off valve (not shown) for each airbrush. For single airbrush use, valve #1 would be open and valve #2 would be closed. System operation at set pressure would exhaust through the pressure control device 58 the difference in pressure between the demand of airbrush #1 and the compressor output. The opening of valve #2 doubles the demand. The pressure control device 58 automatically compensates by exhausting less air; this satisfies the demand of both airbrushes and exhausts the smaller difference in air pressure between the demand of two airbrushes and compressor output, maintaining the pressure control device's pressure setting. This automatic compensation of system air pressure to changes in demand enables the present attachment to work perfectly with either bleeder (constant air flow) or non-bleeder (air flow only by trigger activation) types of airbrushes or other similar air tools.

At the outlet port 74, a threaded nipple 82 and a lock nut 84 connect an end of an air supply hose 86 to the pressure control device 58. The opposite end of the hose 86 is connected to the airbrush 46 as is known in the art.

A second elbow **56*b* engages a slightly longer stub tube 88 equipped with a threaded pipe adapter 90 which is identical to the adapter 60, and, through a 45 degree street elbow 94, receives a pressure indicator gauge 96. The gauge 96 is preferably of the glycerin-filled type to be less sensitive to the vibrations generated by the small compressor 10. Also, due to the longer length of the stub tube 88 compared to the tubular stub 60, the gauge 96 is not obscured by the pressure-control device 58. The provision of the street elbows 66, 94 also angle the respective components to be more easily manipulated and/or read by the operator. It is contemplated that the gauge 96 may be mounted in any easily readable position on the tubular segment 40 as desired, and even may be mounted in the supplemental port 78**.

The compressor 10 is typically supported on a substrate by at least one and preferably four feet 20 fastened to the housing 14, such as by integral casting. In some cases, the feet 20 are provided with resilient pads (not shown). However, the significant vibrations generated during operation tend to cause such compressors to "walk" or move along the substrate.

To address this condition, the present attachment 30 includes a mounting clip 100 which fastens at an upper end 102 to the corresponding foot 20, and has a "C"-shaped lower end 104 which is dimensioned to snap onto the tubular attachment 30 along the first and second leg portions 48, 50. The compressor 10 may be easily removed from the attachment by disengaging the clips 100. Also, the clips 100 may be adjusted so that the tubular segment 40 is parallel, transverse, or has some other disposition relative to the compressor 10, depending on the application. To further stabilize the compressor 10 on the substrate, a plurality of tubular resilient, rubber-like grommets 106 are disposed about the attachment 30 to contact the substrate. In this manner, the compressor 10 is provided with a larger footprint on the substrate and thus maintains its operational position more securely.

In operation, once the compressor 10 is turned on, compressed air flows from the air outlet 22, through the air tube 28 and into the tubular segment 40. Air pressure is uniform within the tubular segment, so that the pressure gauge 96 located on the second leg portion 50 will read the same pressure as that regulated by the pressure control device 58 located in the first leg portion 48. As the operator manipulates the pressure control selector 72, the pressure value indicated on the gauge 96 will vary accordingly. The desired pressure value of compressed air is then sent to the tool or airbrush 46. Excess pressure generated by the compressor 10 is exhausted from the exhaust port 70 and thus does not produce backpressure which is detrimental to compressor longevity. It has also been found that with the exhaustion of excess pressure, operational heat and noise levels have been reduced as compared to compressors operating without the attachment 30.

A further feature of the present attachment relates to its ability to unload stored pressure out the exhaust port 70 within a few seconds of the compressor being turned off. Attempting to restart a conventional 'loaded' compressor will generally result in the motor straining to the maximum, drawing maximum current, without being able to overcome the resistance, which is a condition very damaging to small motors.

Another advantage of the present attachment 30 is that the volume of the tubular segment 40 is such that a reservoir of compressed air is created, which dampens the inherent pulsing operation of the compressor. The result is a more uniform flow of air to the airbrush 46.

By the same token, the conductive material and elongate tubular construction of the tubular segment 40 causes it to act as a heat exchanger or aftercooler by dissipating heat received from the compressor 10 by radiation. Heat generated by the compression of the air is dissipated to the surrounding air. Temperature reduction is facilitated by the labyrinthine configuration of the tubing, which provides a large radiation surface area in proportion to the relatively small volume of the segment 40. It is preferred that the surface to volume ratio of the segment is greater than 1:1. Surface to volume ratios of approximately 5:1 are even more desirable, and a ratio of approximately 10:1 has been found to be quite effective. Specifically, in an embodiment incorporating the 10:1 ratio, temperature of the compressed air passing through the tubular segment 40 has been reduced from the compressor outlet 22 at least as much as 40%, from 150 degrees F. to 80 degrees F.

Further temperature reduction is provided by the construction of the air tube 28, which inhibits conductive heat generated by the compressor from passing downstream into the segment 40. The inside diameter of the air tube 28 is smaller than the inside diameter of the segment 40. Consequently, the air expands as it leaves the air tube and enters the segment 40, creating a cooling effect. In addition, by efficiently cooling the compressed air, moisture is condensed out immediately and cannot be transported downstream to the airbrush.

Thus, the present compressor attachment addresses the primary problems of providing positive air pressure control and an effective visual display of system performance to small, continuously running, air compressors. Through the use of unique design and innovative components, the attachment also provides a number of secondary benefits which were heretofore unavailable in a single system. The damaging effect of heat generated by the compressor is eliminated, as is the undesirable effect of pulsation in the compressed air supply. The problem of compressor 'unloading' is also eliminated. The present system allows the compressor to work at a reduced system pressure, extending compressor life while at the same time reducing the heat of compression and reducing the operating noise level. In addition, the present attachment presents an attractive, durable, compact package only slightly-larger than the compressor itself. Designed to have the compressor mounted on it, the attachment provides a more stable mounting platform, and eliminates the problem of compressor 'walking'. Finally, the present attachment can be constructed to fit any small air compressor, and can be retrofitted to any existing compressor which is already in use.

While a particular embodiment of the performance enhancing base for small compressors of the invention has been shown and described, it will be appreciated by those skilled in the art that changes and modifications may be made thereto without departing from the invention in its broader aspects and as set forth in the following claims.

What is claimed is:

1. A base attachment for use with an air compressor having a motor enclosed within a housing, a compressor unit operatively connected to the motor and emitting compressed air from an air outlet, said base attachment comprising:

a tubular segment having a first end portion for receiving the compressed air emitted by the air outlet, and a second end portion for emitting the air to a pneumatically powered tool;

a pressure controlled device connected to and in fluid communication with said tubular segment for receiving air from the compressor and for emitting air from an outlet port at a preset pressure to the tool, said device having an exhaust port separate from said outlet port, for bleeding off excess pressure;

wherein said tubular segment is constructed and arranged to provide a temperature and pressure regulating sink for emitting compressed air which is cooler and at more uniform pressure than air emitted directly from said air outlet.

2. The attachment as defined in claim 1 wherein said second end portion is located remotely from said first end portion.

3. The attachment as defined in claim 1 wherein said tubular portion has a surface to volume ratio of greater than 1.

4. The attachment as defined in claim 1 further including an air tube for connecting said first end with the compressor air outlet.

5. The attachment as defined in claim 4 wherein said air tube is made of heat insulating material.

6. The attachment as defined in claim 1 wherein said compressor is supported on a substrate by at least one foot, and said tubular segment is configured to support and provide a base for the compressor at said at least one foot.

7. The attachment as defined in claim 6 further including mounting clips for mounting each of said at least one foot to said tubular segment.

8. The attachment as defined in claim 1 wherein said pressure control device is connected to said second end portion for regulating the pressure of both the compressed air contained in said tubular segment as well as the compressed air emitted from said second end portion.

9. The attachment as defined in claim 1 wherein said pressure control means is a relief valve.

10. The attachment as defined in claim 1 further including indicator means in fluid communication with said tubular segment for indicating the pressure of the compressed air emitted by said second end portion.

11. The attachment as defined in claim 10 wherein said indicator means is a liquid filled air pressure gauge.

12. The attachment as defined in claim 10 wherein said tubular segment is generally U-shaped, having a pair of generally parallel leg portions, said pressure control means located at a free end of one of said leg portions, and said indicator means located at a free end of the other of said leg portions.

13. A base attachment for use with an air compressor having an electric motor enclosed within a housing, a compressor unit operatively connected to the motor, the compressor unit emitting compressed air from an air outlet, and at least one foot supporting the compressor on a substrate, said base attachment comprising:

a tubular segment supporting the compressor and having a first end portion for receiving the compressed air emitted by the air outlet, and a second end portion for emitting the air to a pneumatically powered tool; and pressure control means connected to said second end portion for regulating the pressure of both the compressed air contained in said tubular segment as well as the compressed air emitted from said second end portion.

14. The attachment as defined in claim 13 wherein said pressure control means is a relief valve.

15. The attachment as defined in claim 13 further including indicator means in fluid communication with said tubular segment for indicating the pressure of the compressed air emitted by said second end portion.

16. The attachment as defined in claim 15 wherein said indicator means is a liquid filled air pressure gauge.

17. The attachment as defined in claim 15 wherein said tubular segment is generally U-shaped, having a pair of generally parallel leg portions, said pressure control means located at a free end of one of said leg portions, and said indicator means located at a free end of the other of said leg portions.

18. An air compressor and base assembly, comprising:

an air compressor having a motor enclosed within a housing, a compressor unit operatively connected to said motor and having an air outlet for emitting compressed air;

a base attachment including a tubular segment supporting the compressor and having a first end for receiving the compressed air emitted by said air outlet, and a second end for emitting the air to a pneumatically powered tool; and pressure control means connected to said second end portion for regulating the pressure of both the compressed air contained in said tubular segment as well as the compressed air emitted from said second end portion;

wherein said tubular segment is constructed and arranged to provide a temperature and pressure regulating sink so that said compressed air emitted from said second end is cooler and at more uniform pressure than compressed air emitted directly from said air outlet.

19. The assembly as defined in claim 18 wherein said tubular segment is generally U-shaped, having a pair of generally parallel leg portions, and further includes said pressure control means located at a free end of one of said leg portions, and indicator means located at a free end of the other of said leg portions for indicating the pressure level of the compressed air emitted from said second end.

* * * * *

UNITED STATES PATENT AND TRADEMARK OFFICE

CERTIFICATE OF CORRECTION

PATENT NO. : 5,520,519

DATED : May 28, 1996

INVENTOR(S) : Thomas A. Birkeland

It is certified that error appears in the above-indentified patent and that said Letters Patent is hereby corrected as shown below:

On the Cover Page:

In the Title:

Item [54], delete "COMPRESSOR" and insert --COMPRESSORS--.

Column 1, line 2, delete "COMPRESSOR" and insert--COMPRESSORS--.

In the Assignee:

Item [73], delete "Seiko Epson Corporation, Tokyo, Japan" (the application was not assigned).

Column 1, line 64, after "noise", delete "," and insert --.--.

Signed and Sealed this

Twenty-sixth Day of August, 1997

*Attest:*

Bruce Lehman

BRUCE LEHMAN

*Attesting Officer*

*Commissioner of Patents and Trademarks*